US005819442A

United States Patent [19]

Orso

[11] Patent Number: 5,819,442

[45] Date of Patent: Oct. 13, 1998

[54] PAIR OF AUXILIARY REINFORCEMENT PIECES FOR SKI BOOTS EQUIPPED WITH THESE PIECES

[75] Inventor: Pietro Orso, Cassola, Italy

[73] Assignee: Lange International S.A., Switzerland

[21] Appl. No.: 736,612

[22] Filed: Oct. 24, 1996

Related U.S. Application Data

[63] Continuation of Ser. No. 437,882, May 9, 1995, abandoned.

[30] Foreign Application Priority Data

Jun. 2, 1994 [CH] Switzerland ..... 1-722/94

[51] Int. Cl.[6] ..... A43B 5/04; A43B 7/20

[52] U.S. Cl. ..... 36/118.3; 36/89

[58] Field of Search ..... 36/89, 117.1, 118.2, 36/118.3, 119.1

[56] References Cited

U.S. PATENT DOCUMENTS

| | | | |
|---|---|---|---|
| 3,516,180 | 6/1970 | Thurston | 36/119 |
| 3,561,139 | 2/1971 | Stillman | 36/119 |
| 3,824,713 | 7/1974 | Vaccari | 36/118 |
| 3,969,833 | 7/1976 | Vaccari | 36/117 |
| 4,308,674 | 1/1982 | Tessaro | 36/118 |
| 5,317,820 | 6/1994 | Bell et al. | 36/89 |
| 5,575,091 | 11/1996 | Mattiuzzo | 36/117.1 X |

FOREIGN PATENT DOCUMENTS

| | | | |
|---|---|---|---|
| 0484845 | 5/1992 | European Pat. Off. . | |
| 2649594 | 1/1991 | France . | |
| 2514207 | 10/1976 | Germany | 36/117 |
| 2607698 | 9/1977 | Germany | 36/120 |
| 2820074 | 11/1979 | Germany | 36/117 |

*Primary Examiner*—B. Dayoan

*Attorney, Agent, or Firm*—Kane, Dalsimer, Sullivan, Kurucz, Levy, Eisele and Richard, LLP

[57] ABSTRACT

The auxiliary pieces are constituted by semi-rigid plates (1, 2) which are curved about a vertical axis (a) and have an upper part (11, 21) and a lower part (12, 22) offset relative to the vertical axis and to the upper part, on one side as far as one of the pieces is concerned and on the other side as far as the other auxiliary piece is concerned.

Depending on whether each of these pieces is mounted on the right or left boot, the boots are reinforced on the inner side or on the outer side and have different characteristics.

6 Claims, 1 Drawing Sheet

PAIR OF AUXILIARY REINFORCEMENT PIECES FOR SKI BOOTS EQUIPPED WITH THESE PIECES

This application is a continuation of application Ser. No. 08/437,882, filed May 9, 1995, now abandoned.

FIELD OF THE INVENTION

The present invention relates to a pair of auxiliary reinforcement pieces for ski boots, the upper part of which is constituted by a collar intended to surround the bottom of the leg.

PRIOR ART

From patent FR 2 649 594, ski boots are known, that shaft of which, in the form of a collar, is equipped, on the inner side of the leg, with a reinforcement plate intended to increase the rigidity of the shaft on its inner side so as to improve the quality of the transmission of the lateral force from the leg to the ski and consequently the edge gripping during a turn. For its positioning and its holding on the collar, the reinforcement plate is equipped with protuberances which engage in holes of the collar.

Also known is a ski boot equipped with an auxiliary plate which extends vertically on the front of the boot and is held by the collar so as to impart to the boot a certain characteristic of flexion towards the front. This plate can be inverted by 180° to obtain a different flexibility towards the front.

While it is important, in turning, especially in slalom and on ice, that the movements of the leg be transmitted in an instantaneous and accurate manner to the inner edges of the skis so as to ensure good edge gripping, experience has shown that, in downhill, it was important that the skis be properly flat to favor sliding and that good support on the exterior of the boot facilitated this laying flat. Consequently, depending on whether the skier is performing slalom or downhill, especially in competition, it would be judicious for these boots to have different characteristics. These different characteristics could be obtained by specific boots which, however, compels the skier to have two pairs of boots.

SUMMARY OF THE INVENTION

The aim of the present invention is to make possible the instantaneous modification of the characteristics of the boot by means of an auxiliary piece so that the boot is reinforced either on the inner side or on the outer side as the user wishes.

To this end, the pair of auxiliary reinforcement pieces according to the invention is characterized in that these auxiliary pieces are constituted by semi-rigid plates curved about a vertical axis and having an upper part and a lower part offset relative to the vertical axis and to the upper part, on one side as far as one of the pieces is concerned and on the other side as far as the other auxiliary piece is concerned, each of these auxiliary pieces being the reversed image of the other piece.

When these auxiliary pieces are mounted on a pair of boots, their offset parts are therefore both situated either on the inner side of the boots or on the outer side of the boots. In the former case, it is therefore the inner side of the boot which is reinforced and the boot then has the appropriate characteristics for slalom and skiing on ice. In the other case, it is the outer side of the boot which is reinforced and the boot then has characteristics which are appropriate for downhill.

The boots can also be used without the auxiliary pieces so that the skier thus has available a third pair of boots which have neutral behavior and are more flexible.

The auxiliary pieces can be fixed simply by gripping between the flaps of the collar. It is moreover possible to ensure their positioning by the auxiliary means, for example by equipping these plates with a mushroom-shaped part which comes to be attached in a bayonet fit in a cutout of the upper flap of the collar and, if the case arises, with a stud which comes to be engaged between two tongues which constitute the upper flap.

BRIEF DESCRIPTION OF THE DRAWINGS

The attached drawing represents by way of example an embodiment of the invention.

DESCRIPTION OF THE PREFERRED EMBODIMENT

Figure 1:
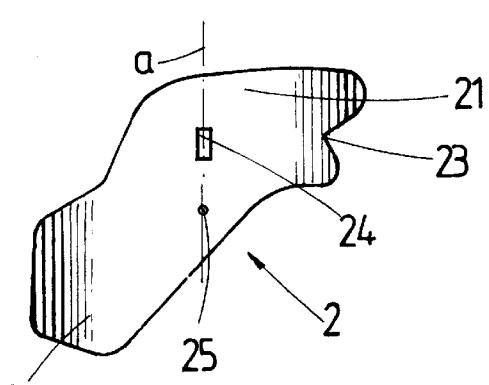
FIG. 1 is a view of the pair of auxiliary pieces.

The pieces 1 and 2 represented in FIG. 1 are constituted by plates made of semi-rigid plastic material, for example of polyurethane of of PVC. These plates have the general shape of a ∫ and are curved about a vertical axis a so as to form a cylindrical surface which extends over approximately 120° and has an upper part 11, respectively 21, and a lower part 12, respectively 22, the part 12 of the piece 1 being offset towards the right relative to the axis of the piece and to the upper part 11, while the lower part 22 is offset towards the left relative to the axis a and to the upper part 21. The lateral edge of the upper part 11 is equipped with a V-shaped notch 13. Similarly, the lateral edge of the part 21 of the piece 2 is equipped with a V-shaped notch 23. The auxiliary pieces are moreover equipped with a mushroom-shaped part with a rectangular head 14, respectively 24, and with a stud 15, respectively 25, situated oriented vertically below the mushroom-shaped part and on the same generatrix as the mushroom-shaped part.

Figure 2:
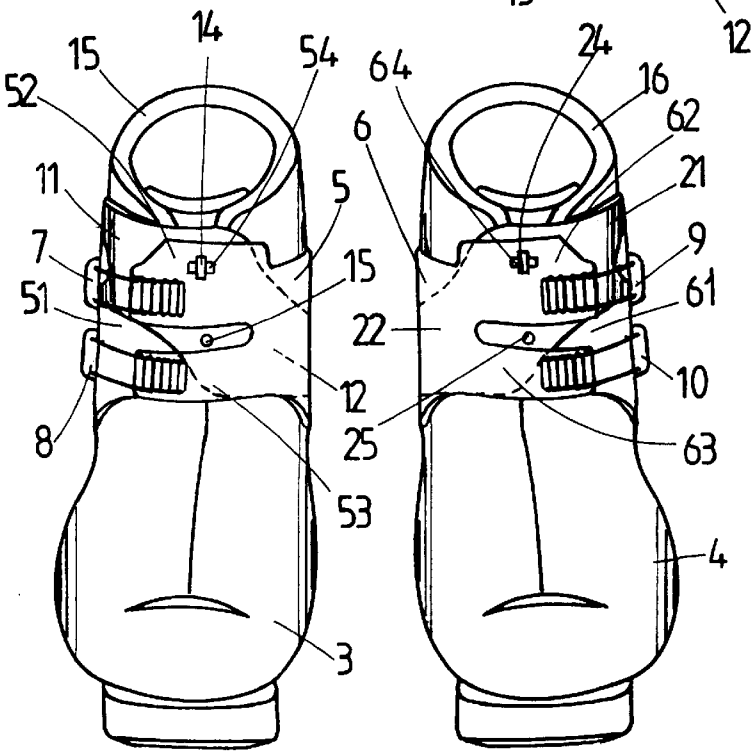
FIG. 2 represents, in a front view, a pair of boots equipped with the auxiliary pieces in FIG. 1, in a first position.

FIG. 2 represents a pair of boots constituted by a right boot 3 and a left boot 4. These boots are equipped with a collar 5, respectively 6, articulated on a shell in a well-known manner. The collar 5 comes to be closed on the front of the leg by a lower flap 51 and an upper flap divided into two tongues 52 and 53. The collar 5 can be closed and tightened by means of two buckles 7 and 8. Similarly, the collar 6 of the left boot is equipped with a lower flap 61 and an upper flap divided into two tongues 62 and 63. The collar is closed and tightened by means of two buckles 9 and 10. Inner comfort boots 15 and 16 can also be seen on the drawing. The upper tongue 52 has a rectangular cutout 54 oriented horizontally. The tongue 62 has an identical cutout 64.

As represented in FIG. 2, the boots 3 and 4 are moreover equipped with auxiliary reinforcement pieces 1 and 2 in the position shown in FIG. 1. As far as the right boot is concerned, the auxiliary reinforcement piece 1 is arranged between the lower flap 51 and the upper flap 52, 53 and it is attached to the tongue 52 of the upper flap by the bayonet fixing constituted by its mushroom-shaped part 14 and the cutout 54 of the tongue, the stud 15 coming to be engaged between the tongues 52 and 53 in such a manner that the upper part 11 of the auxiliary piece extends on the front of the leg and partially on the outer side of the boot, while its lower offset part 12 extends on the inner side of the boot in the direction of the articulation of the collar and comes to bear via its lower edge against the shell of the boot.

The auxiliary piece 2 is fixed in the same manner on the left boot 4. Mounted in this manner, the auxiliary pieces 1 and 2 increase the rigidity of the boot on the inner side of the shaft and improve the support of the leg on the inner edges of the ski.

The auxiliary pieces could bear via their lower edge on a bearing area of the shell.

Figure 3:
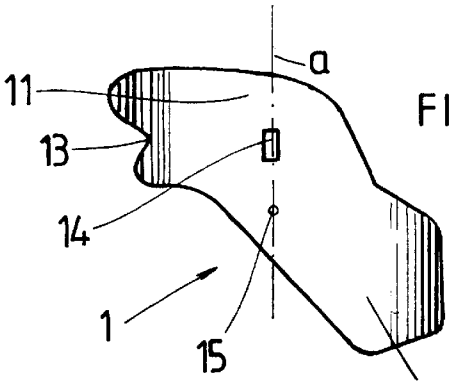
FIG. 3 represents the same pair of boots after transposition of the auxiliary pieces between the boots.
Figure 3:
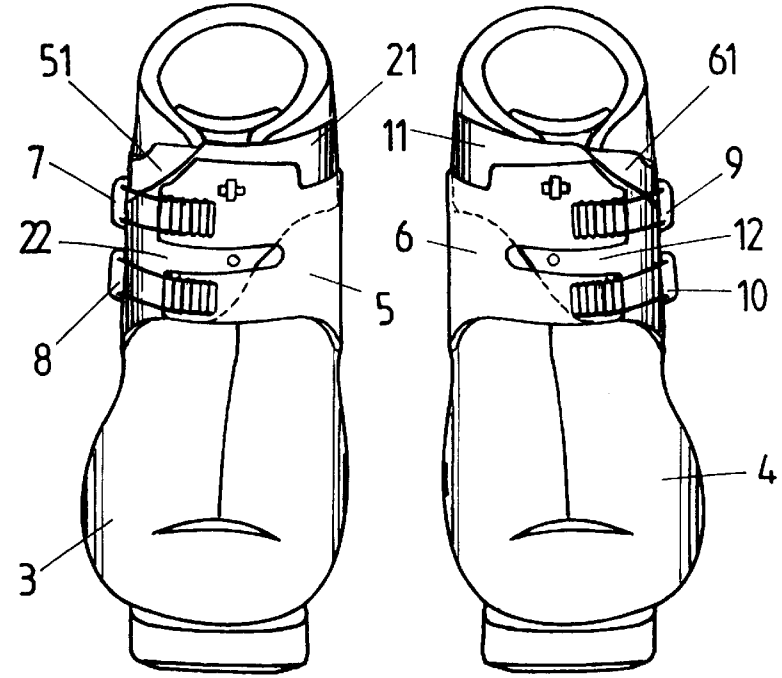

FIG. 3 represents the same boots in the same position after transposition of the auxiliary pieces 1 and 2. The upper part 11, respectively 21, of the auxiliary pieces again extends on the front of the leg, but partially on the inner side of the boot, while the lower part 12, 22 respectively, of these auxiliary pieces extends on the outer side of the boot, under the buckles of the collar. In this case, it is therefore the support on the outer side of the boot which is rendered more heavy-duty and it is the support of the leg on the outer side of the ski which is improved.

The positioning and the holding in position of the auxiliary pieces 1 and 2 could be effected in a different manner, for example by simple adhesion.

Instead of having the shape of a ∫, the plates could have the general shape of a Γ or similar.

I claim:

1. A pair of auxiliary reinforcement pieces for ski boots having an inner and outer side, the upper part of the ski boot being constituted by a collar intended to surround the leg, one reinforcement piece being usable with one boot at a time, these auxiliary pieces being constituted by semi-rigid plates (1, 2) curved about a vertical axis (a) and having an upper part (11, 21) and a lower part (12, 22) offset relative to the vertical axis (a) and to the upper part, on one side as far as one of the pieces is concerned and on the other side as far as the other auxiliary piece is concerned, each of these auxiliary pieces being the reversed image of the other piece, the plates having the general shape of a ∫.

2. A pair of ski boots having an inner and outer side and flaps and each comprising a variable-volume shell surrounding the foot and the heel and a shaft in the form of a collar (5, 6) which is articulated on the shell and equipped with means (7, 8, 9, 10) for tightening the shaft around the leg, and each equipped with an auxiliary reinforcement piece (1, 2) mounted removably on the collar for the purpose of modifying the dynamic behavior of the boot, wherein said auxiliary reinforcement pieces (1, 2) are constituted by semi-rigid plates curved about vertical axis (a) and arranged on the front of the collar between the flaps (51, 52, 53; 61, 62, 63) and have an upper part (11, 21) which extends on the front of the collar and a lower part (12, 22) offset laterally in different directions relative to the upper part each of the plates being reversed image of the other, the lower parts of the plates both being offset on the inner side of the boots for slalom skiing and skiing on ice and adapted to be on the outer side of the boots for downhill skiing:

the auxiliary pieces being so constructed and arranged that the offset part being adapted to be situated on the inner side of the ski boots to reinforce the inner side whereby the boot then has appropriate characteristics for slalom skiing and skiing on ice and being adapted to be situated on the outer side of the ski boots to reinforce the outer side whereby the boot then has appropriate characteristics for downhill skiing and being adapted to be removed from the ski boot for permitting the boot to be more flexible and behave in a neutral manner.

3. A pair of ski boots having an inner and outer side and flaps and each comprising a variable-volume shell surrounding the foot and the heel and a shaft in the form of a collar (5, 6) which is articulated on the shell and equipped with means (7, 8, 9, 10) for tightening the shaft around the leg, and each equipped with an auxiliary reinforcement piece (1, 2) mounted removably on the collar for the purpose of modifying the dynamic behavior of the boot, wherein said auxiliary reinforcement pieces (1, 2) are constituted by semi-rigid plates curved about a vertical axis (a) and arranged on the front of the collar between the flaps (51, 52, 53; 61, 62, 63) and have an upper part (11, 21) which extends on the front of the collar and a lower part (12, 22) offset laterally in different directions relative to the upper part, each of the plates being the reversed image of the other, the lower parts of the plates both being offset either on the inner side or on the outer side of the boots depending on the boot, left or right, on which the auxiliary pieces are mounted.

4. The pair of ski boots as claimed in claim 3, wherein the plates have the general shape of a ∫.

5. The pair of boots as claimed in claim 3, wherein the auxiliary reinforcement pieces (1, 2) are joined to the flaps (52; 62).

6. The pair of boots as claimed in claim 3, wherein the auxiliary reinforcement pieces (1, 2) bear on the shell via their lower edge.

* * * * *